US010210704B2

(12) United States Patent
Roemer

(10) Patent No.: US 10,210,704 B2
(45) Date of Patent: Feb. 19, 2019

(54) UNIVERSAL PLAYER TRACKING SYSTEM UTILIZING MOBILE DEVICES

(71) Applicant: Micki Roemer, Las Vegas, NV (US)

(72) Inventor: Micki Roemer, Las Vegas, NV (US)

( * ) Notice: Subject to any disclaimer, the term of this patent is extended or adjusted under 35 U.S.C. 154(b) by 211 days.

(21) Appl. No.: 14/936,379

(22) Filed: Nov. 9, 2015

(65) Prior Publication Data

US 2016/0133089 A1 May 12, 2016

Related U.S. Application Data

(60) Provisional application No. 62/077,714, filed on Nov. 10, 2014.

(51) Int. Cl.
*G07F 17/32* (2006.01)

(52) U.S. Cl.
CPC ..... *G07F 17/3239* (2013.01); *G07F 17/3218* (2013.01); *G07F 17/3223* (2013.01); *G07F 17/3225* (2013.01)

(58) Field of Classification Search
None
See application file for complete search history.

(56) References Cited

U.S. PATENT DOCUMENTS

| | | | | |
|---|---|---|---|---|
| 6,896,618 | B2 | 5/2005 | Benoy et al. | |
| 7,611,409 | B2 | 11/2009 | Muir et al. | |
| 2005/0153768 | A1 | 7/2005 | Paulsen | |
| 2005/0282603 | A1 | 12/2005 | Parrott et al. | |
| 2013/0090155 | A1 | 4/2013 | Johnson | |
| 2013/0296028 | A1 | 11/2013 | Baerlocher | |
| 2014/0309028 | A1* | 10/2014 | Lyons | G07F 17/3223 463/31 |
| 2015/0045112 | A1* | 2/2015 | Donavan | G07F 17/3244 463/25 |
| 2015/0072752 | A1* | 3/2015 | Melnick | G07F 17/3239 463/20 |

* cited by examiner

*Primary Examiner* — James S. McClellan
*Assistant Examiner* — Peter Iannuzzi
(74) *Attorney, Agent, or Firm* — Weide & Miller, Ltd.

(57) ABSTRACT

A universal player tracking system includes a gaming machine interface. The interface is connected to a communication port of a gaming machine and is configured to connect with a mobile device. The system further includes a remote host, such as one or more servers. The host is independent from any local casino network and communicates with the interface and/or mobile device to receive game play information from the gaming machine and/or to provide information to those devices.

20 Claims, 3 Drawing Sheets

UNIVERSAL PLAYER TRACKING SYSTEM UTILIZING MOBILE DEVICES

RELATED APPLICATION DATA

This application claims priority to U.S. Provisional Application Ser. No. 62/077,714 filed Nov. 10, 2014.

BACKGROUND

1. Field

The present invention relates to methods of presenting and playing games and gaming machines configured to present games.

2. Related Art

Consumer loyalty programs are well known. A company may set up a loyalty program whereby a consumer may subscribe to the loyalty program to achieve points or other rewards for doing business with the company. In turn, the company is able to track the buying habits of the consumer in order to provide better services or products according to the consumer's needs.

Similar loyalty programs are also utilized in the gaming industry. For example, a casino or a group of affiliated casinos may have a player tracking program that tracks the activities of players at a casino, such as their game play activities. The casino may utilize the player tracking system to provide rewards and/or incentives to the players to entice them to visit the casino for achieving predetermined requirements relating to gaming activities.

Such loyalty programs as described above generally require complicated machine hardware to be installed at each point of sale system so that the point of sale system can track purchases from the consumers. Further, each point of sale system is wired to central loyalty server that keeps tracks of loyalty accounts for the consumers. Such systems thus require substantial investment on the part of the business to implant.

In the context of gaming, such loyalty programs require each gaming device to include complicated hardware to implement the player tracking system. Further, each gaming machine is required to be wired to a central player tracking server that must be maintained by the casino or group of casinos.

While player tracking systems are beneficial for the casino that maintains the system, other entities that would benefit from such a system are unable to do so. For example, typical loyalty programs operated by a casino or group of affiliated casinos are not capable of providing a game manufacturer player tracking data analytics on the game play of their machines across a plurality of casino properties. Thus, a new player tracking system and loyalty program overcoming the above drawbacks is desired.

SUMMARY

The disclosed embodiments were developed in light of the above drawbacks and aspects of the invention may include a universal player tracking system which includes an interface device. The interface device is connected to a communication port of a gaming machine and is configured to connect with a mobile device of a player of the gaming machine. The mobile device is used to identify the player to the universal player tracking system and receives game play information from the gaming machine via the interface. The system further includes one or more player tracking servers that are communicatively coupled to the mobile device and/or the interface via a network. Those servers are independent from any local casino network and store the game play information from the gaming machine received by the mobile device or the interface.

The universal playing tracking system may be overlaid onto existing gaming machines and across more than one casino. The universal player tracking system permits universal and integrated tracking of a player's game play relative to any connected machine and is not property or casino dependent.

The universal player tracking system may be utilized to facilitate bonuses, promotions, tournaments, and other activities or events separate from gaming machine play or based upon gaming machine play.

Further objects, features, and advantages of the present invention over the prior art will become apparent from the detailed description of the drawings which follows, when considered with the attached figures.

DETAILED DESCRIPTION OF EMBODIMENTS

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Embodiments of the invention comprise loyalty, incentive or promotional programs, player tracking systems, and methods of tracking consumer activities in various environments such as a gaming environment. The player tracking systems may be implemented on a point of sale system that facilitates a transaction. In one embodiment, the player tracking system is implemented in association with a gaming machine or device and a mobile device.

Figure 1:
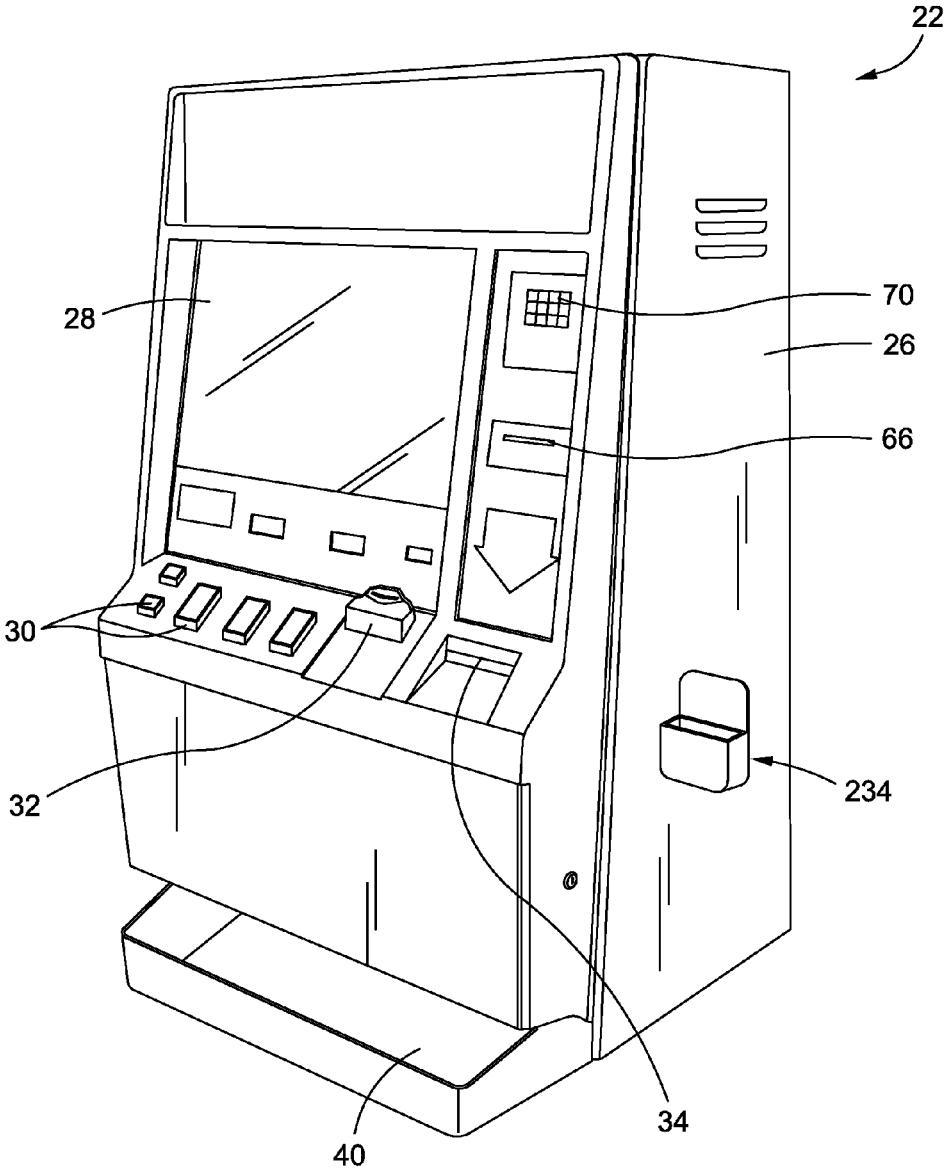
FIG. 1 illustrates a gaming machine with which a universal player tracking system may be implemented, according to one exemplary embodiment.

An example of a gaming machine with which aspects of the invention may be implemented is illustrated in FIG. 1. The gaming machine may be located at a casino (and as such may be referred to as a "casino gaming machine"). As described below, the gaming machine may be part of a gaming system, such as a casino gaming system which links two or more of the gaming machines or one or more gaming machines with other devices, such as one or more table games, kiosks, accounting systems or servers, progressive systems or servers, player tracking systems or servers or the like.

One configuration of a gaming machine 22 is illustrated in FIG. 1. As illustrated, the gaming machine 22 generally comprises a housing or cabinet 26 for supporting and/or enclosing various components required for operation of the gaming machine. In the embodiment illustrated, the housing 26 includes a door located at a front thereof, the door capable of being moved between an open position which allows access to the interior, and a closed position in which access to the interior is generally prevented. The configuration of the gaming machine 22 may vary. In the embodiment illustrated, the gaming machine 22 has an "upright" configuration. However, the gaming machine 22 could have other configurations, shapes or dimensions (such as being of a "slant"-type, "bar-top" or other configuration as is well known to those of skill in the art).

The gaming machine 22 preferably includes at least one display device 28 configured to display game information. The display device 28 may comprise an electronic video display such as a cathode ray tube (CRT), high resolution flat panel liquid crystal display (LCD), projection LCD, plasma display, field emission display, digital micro-mirror display (DMD), digital light processing display (DLP), LCD touch-screen, a light emitting display (LED) or other suitable displays now known or later developed, in a variety of resolutions, sizes and formats (e.g. 4:3, widescreen or the like). The display 28 may be capable of projecting or displaying a wide variety of information, including images, symbols and other indicia or information associated with game play, game promotion or other events. The gaming machine 22 might include more than one display device 28, such as two or more displays 28 which are associated with the housing 26. The gaming machine 22 might also include a top box or other portion. Such a top box might include one or more display devices 28, such as in addition to one or more main displays which are associated with the housing 26. Also, the gaming machine 22 might include side displays (such as mounted to the exterior of the housing 26) and might include multiple displays of differing sizes. The gaming machine 22 might also include other types of game information display devices, such as one or more spinning mechanical reels, wheels or the like.

As described in more detail below, the gaming machine 22 is preferably configured to present one or more games upon a player making a monetary payment or wager. In this regard, the gaming machine 22 includes means for accepting monetary value.

In one embodiment, certain game outcomes may be designated as winning outcomes. Prizes or awards may be provided for winning outcomes, such as monetary payments (or representations thereof, such as prize of credits), or promotional awards. The gaming machine 22 includes means for returning unused monetary funds and/or dispensing winnings to a player.

The gaming machine 22 preferably includes one or more player input devices 30 (such as input buttons, plunger mechanisms, a touch-screen display, joystick, touch-pad or the like). These one or more devices 30 may be utilized by the player to facilitate game play, such as by providing input or instruction to the gaming machine 22. For example, such input devices 30 may be utilized by a player to place a wager, cause the gaming machine 22 to initiate a game, to indicate cards to be held or discarded, to "cash out" of the gaming machine, or to provide various other inputs.

In one preferred embodiment, the gaming machine 22 includes at least one microprocessor or controller for controlling the gaming machine, including receiving player input and sending output signals for controlling the various components of the machine 22 (such as generating game information for display by the display 28). The controller may be arranged to receive information regarding funds provided by a player to the gaming machine, receive input such as a purchase/bet signal when a purchase/bet button is depressed, and receive other inputs from a player. The controller may be arranged to generate information regarding a game, such as generating game information for display by the at least one display 28, for determining winning or losing game outcomes and for displaying information regarding awards for winning game outcomes, among other things.

The controller may be configured to execute machine readable code or "software" or otherwise process information, such as obtained from a remote server. Software or other instructions may be stored on a memory or data storage device. The memory may also store other information, such as pay table information. The gaming machine 22 may also include one or more random number generators for generating random numbers, such as for use in selecting or generating game information or outcomes, whereby game outcomes are presented in a random fashion (and outside of the control of the player or partially based upon the skill of the player).

Preferably, the controller is configured to execute machine readable code or instructions which are configured to implement a method of game play. For example, the controller of the gaming machine 22 may be configured to detect a wager, such as a signal from a player's depressing of the "bet one" button. Upon such an event and/or the player otherwise signaling the gaming machine to present the game, the controller may be configured to cause game symbols or other game information to be displayed on the at least one display 28. The controller may accept input from a player of game inputs, such as a request to spin reels or the like, via the one or more player input devices of the gaming machine 22.

The gaming machine 22 may be configured to generate and present games in a stand-alone manner or it may be in communication with one or more external devices at one or more times. For example, the gaming machine 22 may be configured as a server based device and obtain game code or game outcome information from a remote game server (in which event the gaming machine controller may receive game information from the server, such as game outcome information, and use that server-generated information to present the game at the gaming machine).

As indicated, the gaming machine 22 is configured to present one or more wagering games. Thus, the gaming machines 22 is preferably configured to accept value, such as in the form of coins, tokens, paper currency or other elements or devices representing value such as monetary funds. For example, as illustrated in FIG. 1, the gaming machine 22 might include a coin acceptor 32 for accepting coins. Of course, associated coin reading/verifying devices and coin storage devices may be associated with the gaming machine 22 if it is configured to accept coins. Likewise, the gaming machine 22 might include a media reader 34. Such a reader may be configured to accept and read/verify paper currency and/or other media such as tickets. Of course, in such event the gaming machine 22 may further be configured with one or more paper currency or ticket storage devices, such as cash boxes, and other paper currency or media handling devices (including transport devices).

The gaming machine 22 might also be configured to read FOBs, magnetic stripe cards or other media having data associated therewith and via which value or funds may be associated with the gaming machine 22.

In one embodiment, the gaming machine 22 is configured to award winnings for one or more winning wagering game outcomes. Such winnings may be represented as credits, points or the like. In one embodiment, the player may "cash out" and thus remove previously associated funds and any awarded winnings or such may otherwise be paid to the player. For example, upon an award or at cash-out, associated funds may be paid to the player by the gaming machine 22 dispensing coins to a coin tray. In another embodiment, funds may be issued by dispensing paper currency. In yet another embodiment, a player may be issued a media, such as a printed ticket, which ticket represents the value which was paid or cashed out of the machine. The aspects of gaming machine "ticketing" systems are well known. One such system is described in U.S. Pat. No. 6,048,269 to Burns, which is incorporated herein in its entirety by reference.

The gaming machine 22 may also include a traditional casino player tracking device, such as a card reader 66 and associated keypad 70. As explained above, such player tracking devices are well known and may permit the casino game operator to track play of players of the gaming machine. The casino player tracking device may collect game play information and exchange it with a casino's player tracking server. The tracked play may be utilized to offer player bonuses or awards.

It will be appreciated that the gaming machine illustrated in FIG. 1 is only exemplary of one embodiment of a gaming machine. For example, it is possible to for the gaming machine to have various other configurations, including different shapes and styles and having different components than as just described.

For example, it is possible for games to be presented on a computing device, including at a home or office computer. In one embodiment, a player might log in to a casino server and the controller of the casino server may cause game information to be delivered to the player's computer via a communication link and then be displayed on a display of the player's computer. The communication link might comprise or include the Internet, a casino network such as a wired or wireless LAN, or combinations of public and/or private networks including wired and/or wireless links. In such a configuration it will be noted that the term "controller" may comprise more than one device. For example, in a server-based environment, a controller at a server may generate game information and transmit that information to a local controller at a gaming machine or a player's computer or other electronic device. The local controller at the gaming machine or the player's computer or other electronic device may then cause game information to be displayed on one or more associated displays.

A casino may have numerous such gaming machines 22, such as located on a casino floor or in other locations. Of course, such gaming machines 22 might be used in other environments, such as an airport, a bar or tavern or other locations.

Figure 2:
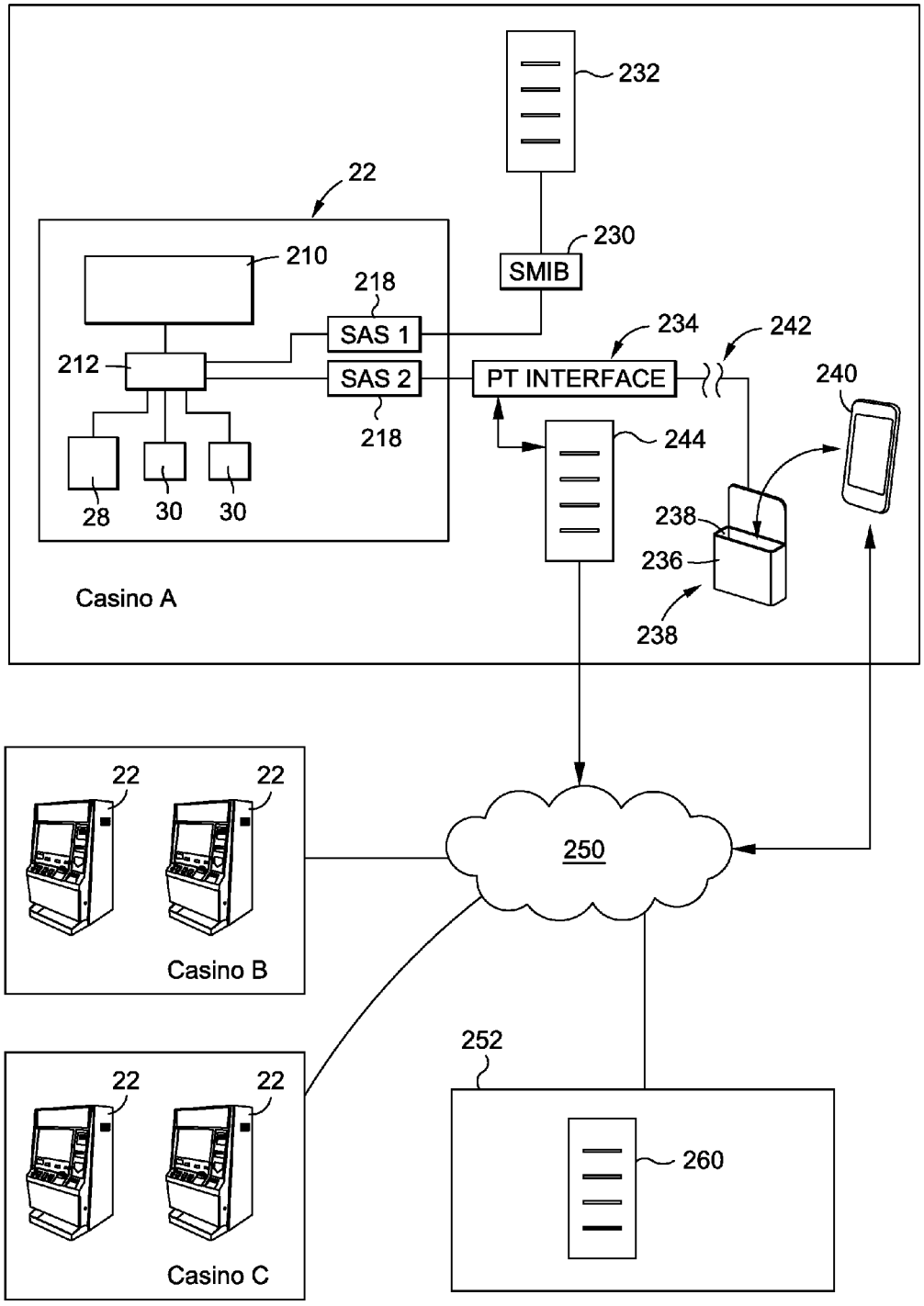
FIG. 2 is a schematic of a gaming machine and player tracking system interface according to one exemplary embodiment.

FIG. 2 illustrates a universal player tracking system of the invention. The system 200 is shown as being associated with or being connected to a gaming machine 22, where elements of the gaming machine are illustrated schematically. It will be appreciated that the universal player tracking system may be implemented relative to a plurality of gaming machines, including gaming machines manufactured by different manufacturers and located in different casinos and/or owned by different owners.

As illustrated in FIG. 2, in one embodiment of the invention, the gaming machine 22 includes a master gaming controller 210 that is connected to an interface, such as input/output device 212. The input/output device facilitates the connection of a plurality of peripherals with the gaming machine master controller 210 to permit communications between the devices. For example, the input/output device 212 connects to the master gaming controller 210, to the display device 28, and player inputs 30, whereby the master gaming controller 210 can send a video output to the display device 28 for display and can receive player input from the player inputs 30. The input/output device 212 is further connected to a plurality of communication ports 218. The communication ports 218 may be one of any suitable standard or proprietary communication port such as a slot accounting system (SAS) or game to system (G2S) protocol port. In one embodiment, for example, the gaming machine may have two SAS ports, such as primary or first SAS1 port and a secondary SAS2 port.

As indicated above, the gaming machine may include a traditional player tracking interface for implementing a traditional casino-based player tracking system. The traditional player tracking interface may include or connect to a slot machine interface board (SMIB) 230 that is connected to one of the communication ports 218, such as the SAS1 port. The SMIB 230 receives data from the master gaming controller 210 in the designated communication protocol (such as the known Slot Accounting System or "SAS" protocol created by IGT of Reno, Nev.) and transmits the data to a casino accounting or player tracking server 232. The data might comprise, for example, information about game play at the gaming machine such as coin-in, coin-out, game wins, losses and other information.

In accordance with the present invention, the gaming machine 22 includes an interface 234 that is communicatively coupled to the gaming machine 22. Preferably, the interface 234 (which may be referred to as a player tracking interface or player tracking interface device) is communicatively coupled to the master gaming machine controller 210 so that it is capable of collecting or receiving information regarding activities at the gaming machine, such as game play information. In one embodiment, the interface 234 is connected to one of the communication ports 218. In an embodiment where the gaming machine 22 includes an existing player tracking device or is otherwise configured so that the SAS1 port is utilized, the interface 234 may be connected to the unused secondary SAS2 port. However, the interface 234 could be coupled to the gaming machine 22 in other manners, such as depending on the configuration of the gaming machine. For example, the gaming machine 22 may not even be coupled to an existing casino player tracking system. In that event, the gaming machine 22 may not include or be connected to a SMIB or include SAS ports, such that the interface 234 may be communicatively coupled to the gaming machine in other manners. In one embodiment, the interface 234 is configured to receive game play information which is output by said gaming machine 22 at said port (and does not transmit information to said gaming machine); although in other embodiments the interface 234 could transmit information to the gaming machine 22, such as by sending a polling request for game play information to said gaming machine 22 via said port.

From one perspective, the interface 234 is simply an electronic device and could thus comprise a circuit board or the like. However, as described below, in a preferred embodiment, the interface 234 includes or is linked to a mobile communication device support 238. The support 238 may comprise a housing 236 or the like. When the support 238 and the interface 234 are combined, the housing 236 may include or support various features of the interface 234 (although not all features of the interface 234 need to be located in or be part of the housing). In an embodiment where a gaming machine 22 is retrofit to implement the present invention, the housing 236 of the interface 234 might be connected to the cabinet or housing 26 of the gaming machine 22 (see FIG. 1). The housing 236 might also be mounted near or adjacent to the gaming machine 22, but not directly to the gaming machine. As illustrated, however, the support 238 may be separate from the interface 234. As one example, the interface 234 may comprise an electronic device which is plugged into the communication port 218 of the gaming 22, such as internally, while the support 238 may be located at another location of the gaming machine 22. For example, as indicated above, the support 238 may be located at a front or side of the gaming machine 22 or other location convenient to the user of the gaming machine 22.

The interface 234 is configured to communicatively couple with a player's mobile device 240. For example, the mobile communication device support 238 of the interface 234 (such as the housing thereof) may include a cradle with a docking device to dock with the mobile device 240. That is, the cradle may be configured to physically support the mobile device 240, but also preferably communicatively couples the mobile device 240 to the interface 234. In this regard, the cradle of the interface 234 may include one or more standard or proprietary connectors such as a LIGHTNING connector to connect APPLE devices or a micro-USB connector. As detailed below, such a connection preferably allows the mobile device 240 to communicate with the interface 234, and thus other devices. Such a coupling may also include or permit other functionality, such as charging of the mobile device 240.

In another embodiment, the mobile communication device support 238 of the interface 234 may be a generally flat supporting surface, such as a flat laminate surface (not shown). The surface may include graphics or other information which instruct a user to "place your phone here" for awards, or other directional information. The interface 234 may include a sensor to identify that the mobile device 240 has been placed on the interface 234. Once the mobile device 240 is detected, the interface 234 may initiate wireless communication between the interface 234 and the mobile device 240 such as through Wi-Fi, Bluetooth, NFC, and the like (the mobile device detector/sensor might comprise a wireless communication interface which detects wirelessly enabled devices in proximity thereto). As a further alternative, a bar code, QR code, or other identifier may be placed on the gaming machine to be scanned by the mobile device 240. When the mobile device 240 scans the identifier, the wireless communication between the interface 234 communication port 218 and the mobile device 240 may be initiated. As yet another embodiment, activation of a button, switch or other input might initiate a communication coupling between the mobile device 240 and the interface 234/gaming machine. In one embodiment, two more means are preferably utilized to form a connection between the gaming machine 22 and/or interface 234 and the mobile device 240. For example, as described below, the interface 234 may detect the mobile device 240, such as via direct connection a wireless signal. The interface 234 may then transmit one or more connection keys or codes to the mobile device 240 for use by the mobile device in forming a communication link therewith (such as a wireless access code). In one embodiment, the interface 234 and the mobile device 240 might further exchange security keys (such as encryption keys) in order to encrypt or secure communications over the established communication link.

Thus, in one embodiment the communication link between the support 238 (and the associated mobile device 240) and the interface 234 may be wired. However, as illustrated in FIG. 2, in another embodiment, communications between the mobile device 240 and the interface 234 may be via a wireless communication link 242.

The player tracking interface 234 and/or support 238 may include other features. For example, if the mobile device charging is facilitated, the interface and/or support might include one or more indicators of charging status (such as green to indicate that the mobile device 240 is being charged, red if not and yellow for a malfunction). Also, an indication of communication linking between the mobile device 240 and the interface 234 may be provided. Again, such might comprise visual indicators to indicate that the player's mobile device 240 is communicatively coupled (or not), such as via green, red, yellow or other lights, etc. Also, when the support 238 facilitates wireless communications between the player's mobile device 240 and the interface 234, the support 238 or other portion of the system might include one or more wireless communication link relays or signal boosters. In another embodiment, the interface 234 might cause the mobile device 240 to emit a tone, ring or display information in order to provide feedback to a player that the mobile device 240 has been connected to the interface and/or provide a similar notification if the communication link is lost or disconnected.

Figure 3:
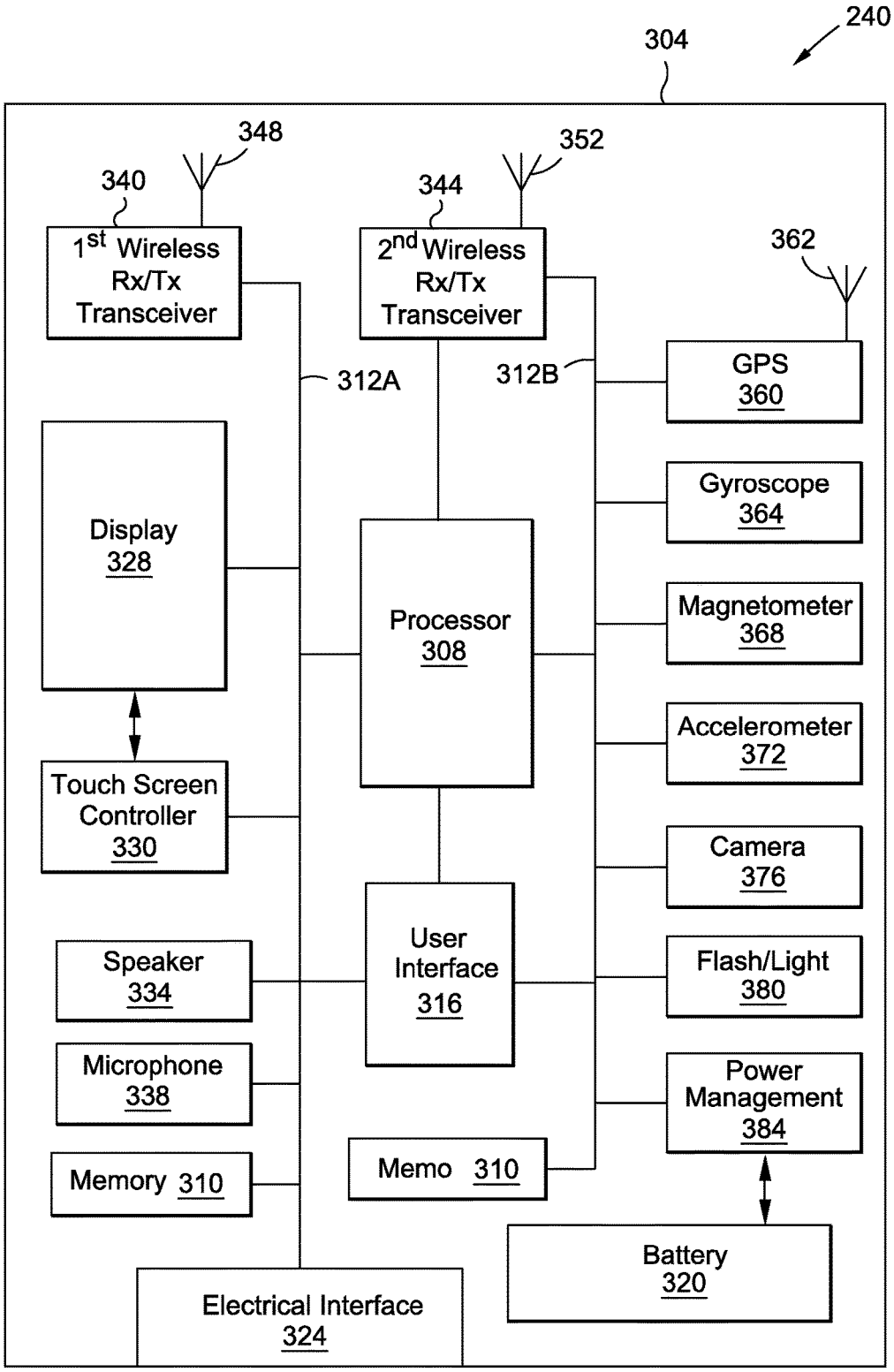
FIG. 3 schematically illustrates a mobile device which may be utilized with the universal player tracking system, according to one exemplary embodiment.

FIG. 3 shows a schematic of a mobile phone 240 according to one embodiment. This is but one possible mobile device configuration and as such it is contemplated that one of ordinary skill in the art may differently configure the mobile device. The mobile device 240 may comprise any type of mobile communication device capable of performing as described below. The mobile device may comprise a PDA, cellular telephone, smart phone, tablet PC, wireless electronic pad, smart watch, or any other computing device.

In this example embodiment, the mobile device 240 is configured with an outer housing 304 configured to protect and contain the components described below. Within the housing 304 is a processor 308 and a first and second bus 312A, 312B (collectively 312). The processor 308 communicates over the buses 312 with the other components of the mobile device 240. The processor 308 may comprise any type processor or controller capable of performing as described herein. The processor 308 may comprise a general purpose processor, ASIC, ARM, DSP, controller, or any other type processing device. The processor 308 and other elements of the mobile device 240 receive power from a battery 320 or other power source. An electrical interface 324 provides one or more electrical ports to electrically interface with the mobile device, such as with a second electronic device, computer, a medical device, or a power supply/charging device. The interface 324 may comprise any type electrical interface or connector format.

One or more memories 310 are part of the mobile device 240 for storage of machine readable code for execution on the processor 308 and for storage of data, such as image data, audio data, user data, medical data, location data, accelerometer data, or any other type of data. The memory may comprise RAM, ROM, flash memory, optical memory, or micro-drive memory. The machine readable code as described herein is non-transitory.

As part of this embodiment, the processor 308 connects to a user interface 316. The user interface 316 may comprise any system or device configured to accept user input to control the mobile device. The user interface 316 may comprise one or more of the following: keyboard, roller ball, buttons, wheels, pointer key, touch pad, and touch screen. A touch screen controller 330 is also provided which interfaces through the bus 312 and connects to a display 328.

The display comprises any type display screen configured to display visual information to the user. The screen may comprise a LED, LCD, thin film transistor screen, OEL CSTN (color super twisted nematic), TFT (thin film transistor), TFD (thin film diode), OLED (organic light-emitting diode), AMOLED display (active-matrix organic light-emitting diode), capacitive touch screen, resistive touch screen or any combination of these technologies. The display 328 receives signals from the processor 308 and these signals are translated by the display into text and images as is understood in the art. The display 328 may further comprise a display processor (not shown) or controller that interfaces with the processor 308. The touch screen controller 330 may comprise a module configured to receive signals from a touch screen which is overlaid on the display 328.

Also part of this exemplary mobile device is a speaker 334 and microphone 338. The speaker 334 and microphone 338 may be controlled by the processor 308 and is thus capable of receiving and converting audio signals to electrical signals, in the case of the microphone, based on processor control. Likewise, the processor 308 may activate the speaker 334 to generate audio signals. These devices operate as is understood in the art and as such are not described in detail herein.

Also connected to one or more of the buses 312 is a first wireless transceiver 340 and a second wireless transceiver 344, each of which connect to respective antenna 348, 352. The first and second transceiver 340, 344 are configured to receive incoming signals from a remote transmitter and perform analog front end processing on the signals to generate analog baseband signals. The incoming signal maybe further processed by conversion to a digital format, such as by an analog to digital converter, for subsequent processing by the processor 308. Likewise, the first and second transceiver 340, 344 are configured to receive outgoing signals from the processor 308, or another component of the mobile device 308, and up convert these signal from baseband to RF frequency for transmission over the respective antenna 348, 352. Although shown with a first wireless transceiver 340 and a second wireless transceiver 344, it is contemplated that the mobile device 240 may have only one such system or two or more transceivers. For example, some devices are tri-band or quad-band capable, or have Bluetooth® communication capability.

It is contemplated that the mobile device, and hence the first wireless transceiver 340 and a second wireless transceiver 344 may be configured to operate according to any presently existing or future developed wireless standard including, but not limited to, Bluetooth, NFC, WI-FI such as IEEE 802.11 a,b,g,n, wireless LAN, WMAN, broadband fixed access, WiMAX, any cellular technology including CDMA, GSM, EDGE, 3G, 4G, 5G, TDMA, AMPS, FRS, GMRS, citizen band radio, VHF, AM, FM, and wireless USB.

Also part of the mobile device is one or more systems connected to the second bus 312B which also interface with the processor 308. These devices include a global positioning system (GPS) module 360 with associated antenna 362. The GPS module 360 is capable of receiving and processing signals from satellites or other transponders to generate location data regarding the location, direction of travel, and speed of the GPS module 360. GPS is generally understood in the art and hence not described in detail herein. A gyroscope 364 connects to the bus 312B to generate and provide orientation data regarding the orientation of the mobile device 304. A magnetometer 368 is provided to provide directional information to the mobile device 304. An accelerometer 372 connects to the bus 312B to provide information or data regarding acceleration, shocks, or forces experienced by the mobile device.

One or more cameras (still, video, or both) 376 are provided to capture image data for storage in the memory 310 and/or for possible transmission over a wireless or wired link or for viewing at a later time. The processor 308 may process image data to perform item recognition, or bar/box code reading.

A flasher and/or flashlight 380, such as an LED light, are provided and are processor controllable. The flasher or flashlight 380 may serve as a strobe or traditional flashlight. A power management module 384 interfaces with or monitors the battery 320 to manage power consumption, control battery charging, and provide supply voltages to the various devices which may require different power requirements.

The memory 310 of the mobile device 240 may include machine readable code (software) that includes an application for implementing aspects of the present invention. For example, a player may download or otherwise install a designated player tracking system application to their mobile device, which application is configured to enable various functionality of the invention. The application may run continuously or be initiated when the mobile device 240 is connected to the interface 234. Preferably, whether the application is already running or initiated when the mobile device 240 is connected, when the mobile device 240 is communicatively coupled to the interface 234, the application implements certain functionality. The mobile device 240 is configured to receive information regarding game play from the gaming machine 22, such as via the interface 234 or, as described below, a remote host.

The universal player tracking system of the invention preferably includes a remote system host 252. The host 252 may comprise one or more servers 260 and/or other devices (user interfaces, work stations, printers, communication interfaces, etc.). In a preferred embodiment, the host 252 is a third party system, e.g. is not associated with a single casino. The servers may be "cloud" servers. As also illustrated in FIG. 2, the system may include one or more local hosts 244. These hosts 244 may comprise servers or other computing devices which are local to a group of machines and may facilitate data collection, firewall, data buffering and other network security and communication functions between the player tracking interfaces 234 and the system host 252 at a local level. For example, one or more local hosts 244 may be located at each casino and serve the gaming machines at that casino and the local hosts 244 at the various casinos may all communicate with the main system host 252.

In one embodiment, the interface 234 may be communicatively coupled to the universal player tracking system host 252, such as the server(s) 260. For example, the interface 234 may be communicatively coupled to the server 260 by a wired or wireless communication link. In a casino retrofit environment, an interface 234 may be associated with one or more existing gaming machines 22 within the casino. Those interfaces 234 may include wireless communication interfaces which allow them to communicate with the server 260, such as via one or more wireless access points and/or other devices (thus avoiding the need to run wires or the like through the casino to connect the interfaces).

In another embodiment, the interface 234 may communicate with the remote or system host 252, such as the server 260, via the player's mobile device 240. The mobile device 240 may be wirelessly connected with a network 250, such as the Internet. Through the network 250, the mobile device 240 can communicate with the server 260, including to upload game play information to the server 260 and/or receive information from the server 260. This configuration is particularly advantageous because it removes the requirement for a communication link between each interface 234 and the remote host 252, as well as the local hosts 244. In essence, in this configuration, the mobile devices of the players become the "network" which links the gaming machines 22 (via the interfaces 234) to the main system host 252. Moreover, when the server(s) 260 are cloud-based, the universal player tracking system essentially becomes virtual, being implemented by applications running on the player mobile device 240 and the cloud servers.

The remote host 252, such as the server 260, maintains player tracking information for players associated with the universal player tracking system. The server 260 is maintained independently from a casino server such as the casino accounting server 232. The player tracking information may include such game play information as coin in, coin out, jackpots, game play, game name, gaming machine manufacturer, serial number, etc.

In operation of the system of the invention, game play or other information is collected by the remote host 252, such as at the server 260. A player may enroll in the universal player tracking system and download or install the player tracking application on their mobile device 240. The player is identifiable to the server 260 by their mobile device 240, such as via a mobile device identifier which ties the device to the player or via the player entering or providing identification information (account number, user ID, password, etc.).

In one embodiment, when a player wishes to play a gaming machine 22, they associate their mobile device 240 with the interface 234. As indicated above, this might comprise the player setting their mobile device 240 on a support surface of the interface 234 or by connecting their mobile phone 240 to the interface 234, such as via a communication port connection.

In another embodiment, the player tracking interface 234 or associated support 238 has a wireless device detection feature, such as an NFC detection device. The user activates the NFC feature on their wireless device 240 and associates their device with the support 238. If the interface 234 is available (not linked to another player's device and the timeout since a last player had their device linked to the interface 234 has expired), the interface 234 detects the player's mobile device 240 and may transmit communication connection information, such as a Bluetooth encryption key and address, to the player's mobile device 240. The player's mobile device 240 uses this information to establish a wireless communication link to the interface 234, such as via Bluetooth. At that time, the interface 234 is locked to prevent pairing or communication with another player's mobile device. Further, other security keys or information may be exchanged between the devices, such as to enhance the security of the communications between them.

As the player plays the gaming machine, game play data is collected, such as by collecting game play related information which is output by the master gaming controller 210 of the gaming machine 22. As indicated above, this information may be collected by the interface 234 via a connection to the master gaming controller 210, such as via a SAS2 port thereof.

In one embodiment, the interface 234 forwards the game play information to the remote host, such as the servers 260. Preferably, the information is tagged or identified as being associated with the player and is thus stored at the server 260 in association with that player. In another embodiment, the game play information is provided by the interface 234 to the player's mobile device 240. The player's mobile device 240 might store the information and/or it might, during game play or at a later time, upload the game play information to the remote host 252. For example, in the event that the interface 234 is not configured to directly communicate with the remote host 252 or the communication link is unavailable, the game play information may be provided to the player's mobile device 240. The player's mobile device 240 might forward the game play information on to the remote host as it receives the information (such as via a wireless communication link) or it might upload the information at a later time. In one embodiment, the interface 234 need not even have a communication link to the remote host 252. Instead, the interface 234 might link to the player's mobile device 240 and then the player's mobile device may link to the host 252 as described herein.

In one embodiment, the player's mobile device 240 may be utilized as a player tracking interface to the gaming machine 22. In particular, while the player's mobile device 240 is associated with the interface 234, the application on the player's mobile device 240 might cause the display of the device to display various information. This information might include a keypad and game play data (such as game play statistics, etc.).

The remote host 252 may communicate with the interface 234 and/or the player's mobile device 240. For example, the remote host 252 may transmit requests for information to the interface 234 or provide information to the interface 234. As one example, the remote host 252 might transmit information regarding a promotion to the interface 234, which information is then provided to the player's mobile device 240 for display to the player.

The player's mobile device 240 may also communicate with the remote host 252 when the mobile device 240 is not associated with an interface 234. For example, after leaving a casino a player may wish to view their game play statistics, information regarding promotions or the like. The player may utilize the application on their mobile device 240 (or in other embodiments, simply use a web browser or the like) to access the remote host 252, such as via a wireless mobile communication network or the like. The remote host 252 may, in response to identification of the player (such as via information about the player's mobile device 240 or by identification information input by the player), provide information to the player. The information might comprise player account related information such as game play information (number of games played, gaming machines played, monies wagered, monies lost, monies won) and a wide variety of other information, such as information regarding promotions or the like.

Because the universal player tracking system does not need to be tied to (does not need to communicate with or couple to) a casino server system, the player tracking system of the invention has a number of advantages. For example, the remote host 262/server 260 may utilize the player tracking information to provide incentives or promotions to a player for wagering a certain amount of money at a particular gaming machine, at a particular manufacturer's gaming machine, or at gaming machines at a particular casino property. Incentives or promotions may also be available for playing a certain amount of time at a gaming machine.

Because the universal player tracking system is not specific to particular gaming machines and does not need to be tied to a specific casino or its existing player tracking system, the system can be utilized relative to gaming machines which present different games, are manufactured by different manufacturers, or are in different locations or have different owners/operators, as illustrated in FIG. 2. For this reason, the universal player tracking system can track game play at a variety of different gaming machines at different casino properties. This allows players to have access to gaming machine play data and player tracking/rewards activities for different gaming machines, including at different casinos. This may allow, for example, players may be able to identify "lucky" gaming machines at different locations (by comparing game play data, such as game win, for gaming machines which are in different casinos and which would otherwise not be linked).

The universal player tracking system may also utilize the data for the benefit of a casino property without the need for complex casino player tracking hardware and networks. Further, data obtained by the player tracking system may be provided to game manufacturers so the manufacturer can evaluate gaming machines across a plurality of casino properties.

As one aspect of the invention, the universal player tracking system is implemented in a manner in which an interface is communicatively coupled to an output or port of a gaming machine. This allows the interface to receive or read information which is output by the gaming machine without having to modify the gaming machine, thus avoiding having to modify the gaming machine to directly link to the interface. This allows existing gaming machines to be interfaced with the universal player tracking system in a manner which avoids issues with regulatory approvals would be needed if the gaming machine itself had to be modified (as is the case currently when gaming machines are modified to include existing player tracking technology).

As one aspect of the invention, a player's mobile device serves as a player tracking device for the player. In one embodiment, player tracking, promotion, tournament, bonus and other information which is obtained and/or generated by the universal player tracking system may be provided to the player's mobile device and thus be presented to the player. In one embodiment, information may be provided to a player while the player's device is coupled to a gaming machine. However, information may also be stored on the player's mobile device. For example, a history of game play, current points balance, award and other information may be provided to and stored on the player's mobile device. Thus, the player might view or review that information even when their mobile device is not coupled to a gaming machine, such as at work or home. In one embodiment, a player's mobile device might also serve as an interface for casino's existing player tracking system. For example, the interface 234 might cause player tracking data which is associated with the casino's player tracking system to be displayed by the player's mobile device, such as while the mobile device is connected to the interface 234 (e.g. the player's mobile device might thus serve as a convenient interface/display for the casino's player tracking system).

The universal player tracking system may further be utilized to report winnings and losses to the IRS. The system may also be used for responsible gaming to limit or control a problem gambler's play activity across multiple casino properties. The system might be used to track game outcomes. In the event of a dispute about a game outcome or payout, the stored game outcome information could be used as a verifier. In one embodiment, the stored game information could be transmitted to the player's mobile device 240 and cause the device to display information regarding the result for their viewing (such as in character or even graphical format).

The universal player tracking system may be configured such that the mobile device 240 may communicate with the gaming machine 22 to provide "free play" on the device with points earned on the player tracking system. During "free play" a player may play for real money where jurisdictions allow. In one embodiment, the "free play" or other game feature could be implemented via the system, such as via the player's mobile device 240. As one example, a player might win a free spin of a bonus wheel based upon their tracked game play level(s) at one or more gaming machines. In one embodiment, the player might associate their mobile device 240 with an interface of a bonus wheel gaming device (which might be entirely separate from the gaming machine (s) which the player was playing). This associate might trigger one or more free spins of the bonus wheel which might yield bonus awards for the player. In one embodiment, the player's mobile device 240 might be used as an interface for such activities. For example, when the player associates their mobile device 240 with the bonus wheel gaming device, their mobile device 240 might display a "press to spin" button on the display thereof, and upon touching the display of their mobile device 240 touchscreen, that input might cause the bonus wheel to spin (virtually or physically). In this regard, as described below, the tracking system of the invention may be associated with devices other than traditional gaming machines, such as secondary bonus or promotional devices, kiosks and the like.

In another embodiment, the system might offer or implement modified or bonus awards. As one example, during certain periods of time (such as determined randomly), all or certain awards for game wins might be enhanced. The enhancement might comprise, for example, a multiplier of 2 or 3 times (or other amount) of the award, extra credits or the like. The user's mobile device 240 and/or interface 234 may detect a qualifying win at the gaming machine and then cause the player's account (e.g. information regarding the award, such as a number of monetary credits, may be stored at the server 260 in association with the player, or in association with another player account or the like) to be credited with the extra or bonus award which is facilitated by the system. The "jackpot window" might be applied to a single player or might be applied to a group of player or machines. The system may include or be linked to signage or other devices which can provide information to the players regarding the jackpot window or period, modified award eligibility or the like. Such might comprise a small video display associated with the interface 234 and/or the support 238 or separate electronic signage or the like near one or more of the machines. Such information might also be displayed on the player's mobile device 240.

As indicated, a player may be required to meet certain criteria in order to be eligible for an award, promotion or the like which is implemented via the system. For example, in one embodiment, a player might be required to place a minimum bet or a side bet in order to be eligible for the award. Compliance with these criteria may be determined by the system. For example, the system may detect, via information received from the gaming machine 22 via the interface 234, whether the player placed the required minimum wager to be eligible for a particular award.

Certain awards which are implemented by the system might be progressive awards. Such awards may grow over time, such as based upon number of games played, wagers placed or the like. In one embodiment, a player might be awarded all or a portion of a progressive jackpot as a result of meeting certain game play criteria of one or more of the gaming machines 22, such as by receiving a designated progressive winning game outcome on the gaming machine 22.

It is also possible to implement games and associated awards on the player's mobile device 240 via the system. For example, a player might receive a notice from the system via their mobile device 240 that they will receive twenty phone game plays for each wagering game played at the gaming machine 22 during a certain time period. The player's game play at the gaming machine 22 is tracked and then the player is awarded the number of phone game plays. The player may then play one or more games on their mobile device 240, such as implemented via the application which is installed on their mobile device 240 which interfaces with the system. The player might receive awards for certain system-implemented game outcomes, such as a progressive jackpot for receiving a particular outcome or the like. Such an award may be associated with the player's account which is on or associated with the system.

In this regard, the universal player tracking system of the invention can be used to facilitate game play, awards, bonuses, promotions, contests and the like, even when the player's mobile device is not coupled to an interface/gaming machine, such as when the player is at home or at work. As one example, based upon tracked game play, a player might be entitled to participate in a promotion. The promotion might be implemented by the server 260 in communication with the player's mobile device 240, whereby the player's mobile device 240 might present the promotion to the player apart from a gaming machine 22/when it is not associated with a gaming machine 22.

In one embodiment, bonus, enhanced or other awards may be credited to the player's tracking account. The player may then later access those awards, such as for use in playing games or to have them cashed out. For example, a player might receive a game winning outcome and an associated award of $100 a gaming machine. The player might have also been eligible for a 2× multiplier bonus award via the system for that win and thus be credited another $100 to their system-based account. The player might later have that $100 cashed out of their account in cash, such as at a cashier cage, transferred to ApplePay™, PayPal™, a digital wallet or other electronic banking or payment systems.

Tournaments might also be implemented via the system. As one example, of a tournament, the one or more players who win the most money playing a fixed number of games (such as slot games, video poker games, etc.) or number of games during a time period, may be awarded an award (such as a fixed award such as a fixed jackpot, a progressive jackpot, pool, etc.). In particular, the system can track each qualifying game played by a player (such as each game played during the tournament period), plus wagers made/coin-in and awards awarded/coins out, and/or other information which can be used to determine which player(s) won the tournament. In one embodiment, information regarding the tournament, such as a current leader board, may be generated by the system (such as at the host 252) and may be transmitted for display by the player's mobile device 240. In this manner, a tournament is implemented by the system relative to individual games which are played by players of the gaming machines 22, without having to modify the operation of the gaming machines 22.

In general, the universal player tracking system may be utilized to implement various types of promotions or incentives, games, bonus events or awards. As another example, a gaming machine manufacturer might sponsor a promotion where a player wins a promotional award if they play a certain number of their gaming machines or wager certain amounts on their gaming machines. An advantage of the system of the invention is that the manufacturer's gaming machines may be at a plurality of different casinos. In the past, a player's play of those machines was not linked. In accordance with the invention, the player's play of those machines at entirely different casinos can be tracked, thus linking the play information.

It will be appreciated that aspects of the invention may be applied to other environments, such as stores or other locations, such as relative to point of sale or other purchasing systems. For example, an interface might be associated with a point of sale or other store inventory and accounting system or components thereof, such as cash registers or the like. A person's purchases or the like may be tracked, such as relative to a plurality of different stores (retail stores, gas stations, grocery stores, restaurants, etc.), in similar fashion including the player's mobile device.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A universal player tracking system for one or more gaming machines comprising:

a first casino gaming system comprising:

a first casino gaming machine;

a first casino player tracking server communicatively linked to said first casino gaming machine;

a player tracking interface device communicatively coupled to a communication port of said first casino gaming machine, the player tracking interface device being configured to communicatively couple to a mobile device of a player of said first casino gaming machine whereby said mobile device of said player of said first casino gaming machine receives information regarding game play activity of said player at said first casino gaming machine from the first casino gaming machine via the player tracking interface device and wherein said first casino gaming machine transmits said information regarding game play activity of said player of said first casino gaming machine to said first casino player tracking server;

a second casino gaming system comprising:

a second casino gaming machine;

a second casino player tracking server communicatively linked to said second casino gaming machine;

a player tracking interface device communicatively coupled to a communication port of said second casino gaming machine, the player tracking interface device being configured to communicatively couple to a mobile device of a player of said second casino gaming machine whereby said mobile device of said player of said second gaming machine receives information regarding game play activity of said player at said second casino gaming machine from the second casino gaming machine via the player tracking interface device and said second casino gaming machine transmits said information regarding game play activity of said player of said second gaming machine to said second casino player tracking server; and at least one remote universal player tracking server that receives said information regarding game play activity of said player of said first casino gaming machine transmitted from said mobile device of said player of said first gaming machine and receives said information regarding game play activity of said player of said second casino gaming machine transmitted from said mobile device of said player of said second casino gaming machine.

2. The universal player tracking system in accordance with claim 1 wherein said player of said first casino gaming machine and said player of said second casino gaming machine are the same.

3. The universal player tracking system in accordance with claim 1 wherein said player tracking interface device which is communicatively coupled to said first casino gaming machine and/or said second casino gaming machine comprises a mobile device interface communicatively linking said mobile device to said player tracking interface device.

4. The universal player tracking system in accordance with claim 3 wherein said mobile device interface comprises a housing which is configured to support said mobile device.

5. The universal player tracking system in accordance with claim 4 wherein said housing is connected to a cabinet of said gaming machine.

6. The universal player tracking system in accordance with claim 3 wherein said mobile device interface comprises at least one mobile device communication port connector configured to connect to a communication port of said mobile device.

7. The universal player tracking system in accordance with claim 1 wherein said first casino gaming machine is connected to said first casino player tracking server via a primary SAS communication port of said first casino gaming machine and said player tracking interface device is communicatively coupled to a secondary SAS communication port of said first casino gaming machine.

8. The universal player tracking system in accordance with claim 1 wherein said player tracking interface device which is communicatively coupled to said first and/or second casino gaming machine is configured to communicatively couple to said mobile device via a wireless communication link.

9. A method of tracking player game play of one or more gaming machines comprising:

establishing a communication link between a player tracking interface which is coupled to a communication port of a gaming machine and a mobile device of a player of said gaming machine;

receiving information from said mobile device which identifies said player;

receiving game play information at said player tracking interface device from said gaming machine regarding game play activity of said player at said gaming machine;

transmitting said game play information to said mobile device over said communication link;

receiving said game play information at a universal player tracking server as transmitted from said mobile device; and storing said game play information in association with said universal player tracking server as linked to said player.

10. The method of claim 9 wherein said communication link comprises a wireless communication link.

11. The method of claim 9 wherein said step of establishing said communication link comprises detecting said mobile device with said player tracking interface device, transmitting communication connection information from said player tracking interface device to said mobile device and receiving a request to establish a wireless communication link from said mobile device at said player tracking interface device.

12. The method in accordance with claim 9 wherein said universal player tracking server is separate from a local casino player tracking server.

13. The method in accordance with claim 9 wherein said step of receiving comprises receiving said game play information as transmitted over a second communication link between said mobile device and said at least one player tracking server, said at least one second communication link comprising a cellular network.

14. The method in accordance with claim 9 further comprising implementing at least one game, promotion or bonus event via said universal player tracking server.

15. The method in accordance with claim 14 further comprising transmitting information regarding said at least one game, promotion or bonus event from said universal player tracking server to said player tracking interface device and from said player tracking interface device to said mobile device for display to said player.

16. The method in accordance with claim 14 further comprising awarding a bonus award to said player if said game play information meets criteria for said bonus award.

17. The method in accordance with claim 16 further comprising storing information regarding said bonus award at said universal player tracking server.

18. The method in accordance with claim 17 wherein said information regarding said bonus award comprises a number of monetary value credits.

19. The method in accordance with claim 9 wherein said step of establishing said communication link comprises said player tracking interface detecting said mobile device via information transmitted from said mobile device, said player tracking interface transmitting communication connection information to said mobile device in response to said detecting, and said mobile device using said communication connection information to request a communication link with said player tracking interface.

20. The method in accordance with claim 9 wherein said gaming machine does not transmit said game play information directly to said universal playing tracking server.

* * * * *